United States Patent [19]

Reuter

[11] Patent Number: 4,545,502

[45] Date of Patent: Oct. 8, 1985

[54] REFUSE CONTAINER HAVING AN UPPER ROLLED LIP PORTION AND COOPERATING COVER

[75] Inventor: Edward J. Reuter, Excelsior, Minn.

[73] Assignee: Reuter, Inc., Hopkins, Minn.

[21] Appl. No.: 609,731

[22] Filed: May 14, 1984

[51] Int. Cl.[4] ..... B65D 43/14; B65D 51/04

[52] U.S. Cl. ..... 220/334; 220/1 T

[58] Field of Search ..... 220/1 T, 334, 339, 333, 220/334

[56] References Cited

U.S. PATENT DOCUMENTS

| | | | |
|---|---|---|---|
| 4,213,539 | 7/1980 | Reuter | 220/333 |
| 4,407,427 | 10/1983 | Reuter | 220/339 |
| 4,420,168 | 12/1983 | Dewing | 220/1 T |

*Primary Examiner*—George T. Hall

*Attorney, Agent, or Firm*—Merchant, Gould, Smith, Edell, Welter & Schmidt

[57] ABSTRACT

A refuse container having an upper rolled lip portion and cooperating cover is disclosed. The upper edge of the refuse container is directed outwardly and downwardly to form a rolled lip (30) defining a channel (32) on the exterior of the container (21) along the entire upper circumference of the container. The container cover (22) includes two sections, a first section (24) that is secured to the lip of the refuse container and a second section (28) that is hingedly attached (26) to the first section (24) of the cover (22) to allow access to the container (21) when lifted.

2 Claims, 4 Drawing Figures

FIG. 2
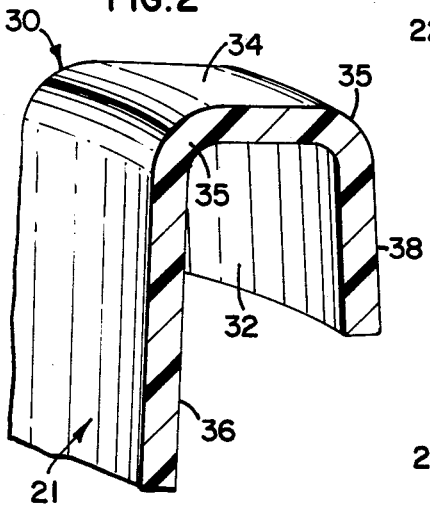
FIG. 1
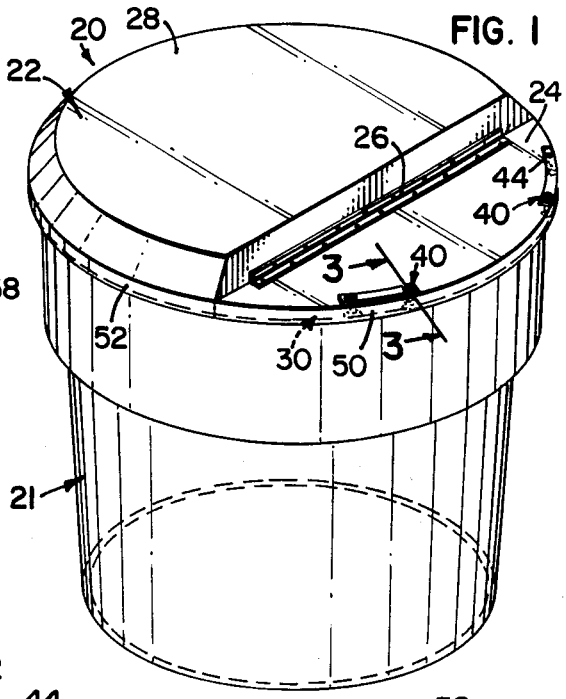
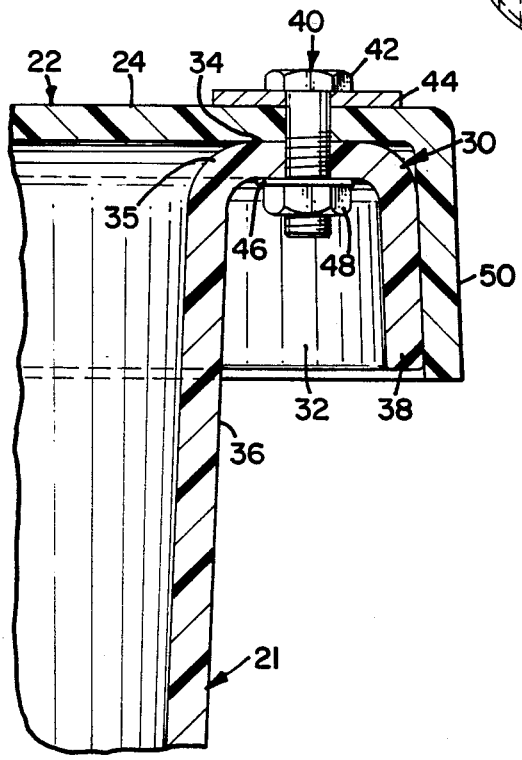
FIG. 3
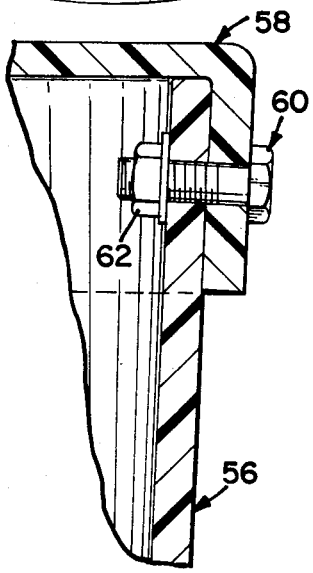
FIG. 4
PRIOR ART

REFUSE CONTAINER HAVING AN UPPER ROLLED LIP PORTION AND COOPERATING COVER

BACKGROUND

The present invention relates to a refuse container having an upper rolled lip and cooperating cover. More particularly, the present invention relates to a refuse container having an outwardly and downwardly rolled lip along the upper circumference thereof and a container cover cooperating with the lip portion to provide a refuse container with several advantages over existing containers.

Currently, there are various types of large commercial containers on the market. However, most of these containers are subject to various functional problems.

A number of existing refuse containers have an inner ridge at the top of the container or some other obstruction on the interior of the container. A container with such an inner ridge or other obstruction cannot be emptied effectively due to various items such as rags or paper catching and hanging on the container's inner ridge.

The configuration of some existing refuse containers does not allow the formation of a tight seal between the top of the container and its cover. Without an adequate seal a container may be susceptible to moisture and flies. Many containers also have a tendency to warp, thereby further aggravating this problem.

The refuse containers which exist are in many cases difficult to assemble. Typically, the refuse container and cover are attached to each other by means of a bolt apparatus which is secured within the container and is in many cases difficult to reach for adjustment or repair. This is especially true in the case of large commercial refuse containers.

In addition, many existing containers lack sufficient structural rigidity to maintain their configuration when being emptied and as the container ages. In addition to other problems, the lack of structural rigidity can interfere with the handling of the container and can result in the cover not fitting properly on the container. Also, the appearance of such containers deteriorates with time.

The present invention solves these and many other problems associated with currently available refuse containers.

SUMMARY OF THE INVENTION

The present invention relates to a refuse container/-cover assembly. The upper edge of the refuse container is directed outwardly and downwardly to form a lip defining a channel on the exterior of the container along the entire upper circumference of the container. The container cover includes two sections, a smaller flat semi-circular section which is secured to the lip of the refuse container by means of bolt apparatuses and a larger raised semi-circular section which is hingedly attached to the smaller flat semi-circular section of the cover.

The present invention is particularly advantageous in that the outwardly and downwardly rolled lip along the upper circumference of the refuse container provides structural rigidity to the container so that the top shape of the container is retained during dumping and as the container ages. Additionally, many conventional refuse containers have a ridge along the upper circumference of the container or the interior surface which may catch rags, papers and similar waste. The outwardly rolled lip in the present invention facilitates cleaner dumping of the container.

Furthermore, the rolled lip on the present invention may serve as a handle for grasping and handling the container. This is particularly beneficial on large commercial containers having a capacity of several hundred gallons.

In one embodiment of the invention the mating surfaces of the refuse container and cover are molded rather then trimmed or cut. This creates a tighter seal to preclude excessive moisture and flies from entering the refuse container.

Another advantage of the present invention is the attachment of the container cover to the outside of the refuse container. Attaching the container cover by means of a bolt apparatus to the outwardly rolled lip of the refuse container eliminates the assembly and maintenance difficulties associated with large commercial containers having bolt apparatus secured on the inside of the refuse container as generally shown in FIG. 4. A typical conventional refuse container is approximately 3 to 4 feet high and has a diameter of approximately 4 to 5 feet. In a refuse container with these dimensions, a bolt apparatus such as that shown in FIG. 4 would be difficult to reach. This frequently requires that a person crawl inside the container in order to fasten the cover.

These and various other advantages and features of novelty which characterize the invention are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals indicate corresponding parts throughout the several views, FIG. 1 is a perspective view of a preferred embodiment of the present invention;

FIG. 2 is a fragmental perspective enlarged sectional view showing the outwardly and downwardly rolled lip feature of the embodiment shown in FIG. 1;

FIG. 3 is a partial enlarged sectional view taken generally along the line 3—3 in FIG. 1;

FIG. 4 is a partial enlarged sectional view of an example of prior art for securing a cover to a refuse container by means of a bolt apparatus.

DETAILED DESCRIPTION OF A PREFERRED EMBODIMENT

Referring now to the drawings, there is shown in FIGS. 1 through 3 a preferred embodiment of the present invention generally referred to by the reference number 20. As is illustrated, the preferred embodiment of the present invention includes a container 21, conventional refuse containers having a volume of 300+ gallons, and a two-section container cover 22 having a smaller flat semi-circular section 24 attached by a hinge 26 to a larger generally raised and domed semi-circular section 28. The smaller flat semi-circular section 24 is attached in a fixed position to an outwardly and downwardly extending upper edge portion of the container 21, herein referred to as the rolled lip 30, which runs along the entire upper circumference of the refuse container 21. The rolled lip 30 forms a downwardly opening channel 32 about the exterior of the container having a U-shaped cross section with a horizontal top wall portion 34 and generally vertical sidewall portions 36 and 38. Preferably, the channel 32 will have a width and depth sufficient for insertion of one's fingers to enable the side wall 38 to be grasped with one's hands, whereby the rolled lip 30 formed around the channel 32 may function as a handle for the refuse container.

In the preferred embodiment the smaller flat semi-circular section of the container cover 24 is attached to the curvilinear top wall portion 34 of the rolled lip 30 of the refuse container 21 by means of two pairs of bolt apparatus 40. The bolt apparatus 40 are located on the smaller flat semi-circular section 24 of the container cover 22 at points along the circumference of the refuse container 21 that assure that the container cover 22 will be firmly secured. In the preferred embodiment, each pair of bolt apparatus 40 is located along the outer edge of the smaller flat semi-circular section of the container cover 22 at equal distances from the points where the larger raised segment of the container cover 22 and the smaller flat segment of the container cover 22 meet.

Each bolt apparatus 40 used to secure the smaller flat semi-circular section 24 of the container cover 22 to the top wall portion 34 of the refuse container's rolled lip 30 includes a bolt 42, an upper bracket-type washer 44 which is located between the head of each bolt 42 and the upper surface of the smaller flat semi-circular section of the container cover 22 (in the preferred embodiment there is one bracket type washer 44 for each pair of bolt apparatus 40), a lower washer 46 located on the under side of the top wall protion 34 of the refuse container's rolled lip 30, and a securing nut 48 which is attached to the bolt 42 in the refuse container's rolled lip channel 32.

In the preferred embodiment, when the smaller flat semi-circular section 24 of the container cover 22 is attached and secured to the rolled lip 30 of the refuse container 21 by the two pairs of bolt apparatus 40, the hinge 26 allows the larger raised semi-circular section 28 of the container cover 22 to be raised or lowered so as to allow the refuse container 21 to be emptied.

It will be appreciated that when the smaller flat semi-circular section 24 of the container cover 22 is secured to the rolled lip 30 of the refuse container 21 a tight seal is formed between that section of the container cover 22 and the refuse container 21. More specifically, the seal is created between the bottom surface of the smaller flat semi-circular section 24 and the surface of the top wall portion 34 of the refuse container's rolled lip 30. Structural rigidity is added to the container 21 by the overlapping of the outer sidewall 38 of the refuse container's rolled lip 30 and the downwardly bent sidewall portion 50 of the smaller flat semi-circular section 24. The proximity of the container's outer sidewall 38 to the downwardly bent sidewall portion 50 of the smaller flat semi-circular section 24 of the cover 22 also provides additional sealing between the cover 22 and refuse container 21. A similar seal is formed between the larger raised semi-circular section 28 of the container cover 22 and the rolled lip 30 of the refuse container 21. This seal is formed at the point of contact between the larger raised semi-circular section 28 of the container cover 22 and the top wall portion 34 of the refuse container's rolled lip 30. The overlapping of the outer sidewall 38 of the refuse container 21 and a downwardly bent sidewall portion 52 of the larger raised semi-circular section 28 of the container cover 22 adds structural rigidity and some additional sealing to this portion of the refuse container and cover.

In FIG. 4, a prior art refuse container 56 is shown attached to a cover 58. Unlike the present invention which provides for securing the container cover such that both ends of the bolt apparatus 40 are located outside of the refuse container 21, the cover 58 illustrated in FIG. 4 is secured by a bolt apparatus 60 which requires tightening a nut 62 against the inside wall of the refuse container 56. Comparison of the refuse container/cover assembly features illustrated in FIGS. 3 and 4 point out the clear advantage of the rolled lip 30 of the present invention. The present invention provides for easier assembly and maintenance of the refuse container/cover assembly as the cover can be readily attached and/or removed due to the ready access of the fastening apparatus on the outside of the container.

Preferably, the container 21 and cover 22 are made of molded plastic by such methods as blow molding or rotational molding. Radiused wall portions 35 interconnecting the top wall portion 34 to the side walls 36, 38, preferably have a one-half inch outside diameter radius in some applications.

The present invention has particular utility for use with large commercial containers which are subjected to substantial hard use and because of their size, make it difficult to attach the covers from the interior of the containers. It will be appreciated that the present invention can be used with other configurations of containers and covers.

It is to be understood, however, that even though numerous advantages and characteristics of the invention have been set forth in the foregoing description, together with details of the structure and function of the invention, the disclosure is illustrative only, and changes may be made in detail, especially in matters of shape, size and arrangement of parts within the principle of the invention, to the full extent indicated by the broad general meaning of the terms in which the appended claims are expressed.

What is claimed is:

1. A refuse container assembly, comprising:

(a) container means open at the top thereof for receipt of refuse, the container means including a sidewall and a bottom wall, an upper edge portion about a top circumference of the container means extending outwardly away from the container means and downwardly, the upper edge portion having a downwardly opening channel about the exterior of the container means having a U-shaped cross section, the channel further having first and second spaced apart, downwardly extending sidewalls and a top wall interconnecting the first and second sidewall, the top wall of the U-shaped channel including a radiused portion proximate each end thereof interconnecting the first and second sidewalls, the first sidewall being formed by the sidewall of the container means, the second sidewall being spaced outwardly therefrom;

(b) container cover means for enclosing the container means, the container cover means including a first section secured to the U-shaped channel and a second section hingedly attached to the first section, the first and second sections including outer edges directed downwardly about the circumference of the container means, said outer edges extending parallel to and being in contact with the second sidewall of the U-shaped channel; and (c) fastener means for fastening the first section of the cover means to one of the top and second sidewalls of the U-shaped channel whereby the container cover means can be fastened to the outside of the container means.

2. A refuse container assembly, comprising:

(a) a container;

(b) an outwardly and downwardly rolled lip portion along the entire upper circumference of an upper portion of the container, the rolled lip portion cooperating with the upper portion of the container to define a channel about the exterior of the container, said channel including first and second sidewalls and a top wall portion intermediate of said first and second sidewalls, said first sidewall being formed by the upper portion of the container and the second sidewall being a downwardly directed portion of the rolled lip portion which is parallel with the first sidewall so as to provide an unobstructed entrance into the channel; and (c) a cover for the container which includes two sections, a first section secured to the rolled lip portion along the upper circumference of the container and a second section hingedly attached to the first section in order to allow access to the container when the second section is lifted, the first section of the cover being secured to the rolled lip portion of the container by a plurality of fastener apparatus extending through the cover and one of the top and second sidewalls so as to be accessible from the outside of the container, the first and second sections of the cover being bent downwardly so as to be in contact with the downwardly directed portion of the rolled lip portion when in a covered position thereby enhancing the rigidity of the container.

* * * * *